US009954297B2

(12) United States Patent
Watanabe et al.

(10) Patent No.: US 9,954,297 B2
(45) Date of Patent: Apr. 24, 2018

(54) TERMINAL FITTING AND CONNECTOR

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Hajime Watanabe, Mie (JP); Yoshifumi Saka, Mie (JP); Shigeru Sawada, Mie (JP)

(73) Assignees: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

( * ) Notice: Subject to any disclaimer, the term of this patent is extended or adjusted under 35 U.S.C. 154(b) by 0 days.

(21) Appl. No.: 15/516,857

(22) PCT Filed: Oct. 16, 2015

(86) PCT No.: PCT/JP2015/079288

§ 371 (c)(1),
(2) Date: Apr. 4, 2017

(87) PCT Pub. No.: WO2016/067935

PCT Pub. Date: May 6, 2016

(65) Prior Publication Data

US 2017/0302016 A1 Oct. 19, 2017

(30) Foreign Application Priority Data

Oct. 30, 2014 (JP) ..... 2014-221099
Feb. 16, 2015 (JP) ..... 2015-027786

(51) Int. Cl.
*H01R 12/70* (2011.01)
*H01R 13/03* (2006.01)
(Continued)

(52) U.S. Cl.
CPC ..... *H01R 13/03* (2013.01); *C25D 3/12* (2013.01); *C25D 3/30* (2013.01); *C25D 3/50* (2013.01);
(Continued)

(58) Field of Classification Search
CPC .... H01R 13/03; H01R 12/58; H01R 12/7064; H01R 12/7082; C25D 3/30; C25D 5/10; C25D 5/12; C25D 7/00
See application file for complete search history.

(56) References Cited

U.S. PATENT DOCUMENTS 9,673,547 B2 * 6/2017 Saka ..... H01R 13/03
2012/0107639 A1 * 5/2012 Takamizawa ..... C25D 5/10 428/620
(Continued)

FOREIGN PATENT DOCUMENTS

JP H11193494 A 7/1999
JP 2003147579 A 5/2003
(Continued)

OTHER PUBLICATIONS

International Search Report and Written Opinion for application No. PCT/JP2015/079288 dated Dec. 1, 2015, 6 pages.
(Continued)

*Primary Examiner* — Edwin A. Leon
*Assistant Examiner* — Oscar Jimenez
(74) *Attorney, Agent, or Firm* — Reising Ethington, P.C.

(57) ABSTRACT

A terminal fitting having a smaller terminal insertion force than before. The terminal fitting includes a backing material made of a metal material and a plating coating covering a
(Continued)

surface of the backing material. The plating coating contains a Sn parent phase and Sn—Pd based particles dispersed in the Sn parent phase and includes an outermost layer having an outer surface in which the Sn parent phase and the Sn—Pd based particles are present. Further, the number of the Sn—Pd based particles present in the outer surface of the plating coating in a state where only the Sn parent phase is removed is 10 to 400 Sn—Pd based particles per 500 $\mu m^2$.

6 Claims, 6 Drawing Sheets

(51) Int. Cl.

| | |
|---|---|
| ***C25D 3/50*** | (2006.01) |
| ***C25D 5/12*** | (2006.01) |
| ***C25D 5/50*** | (2006.01) |
| ***C25D 3/12*** | (2006.01) |
| ***C25D 7/00*** | (2006.01) |
| ***C25D 3/30*** | (2006.01) |

(52) U.S. Cl.
CPC ..... *C25D 5/12* (2013.01); *C25D 5/505* (2013.01); *C25D 7/00* (2013.01); *H01R 12/7064* (2013.01); *H01R 12/7082* (2013.01)

(56) References Cited

U.S. PATENT DOCUMENTS

| | | | | |
|---|---|---|---|---|
| 2015/0047879 | A1* | 2/2015 | Shibuya | C23C 14/14 174/126.2 |
| 2015/0133005 | A1 | 5/2015 | Saka | |
| 2016/0240950 | A1* | 8/2016 | Watanabe | H01R 13/03 |

FOREIGN PATENT DOCUMENTS

| | | | |
|---|---|---|---|
| WO | WO2008038331 | A1 | 4/2008 |
| WO | WO2013168764 | A1 | 1/2016 |

OTHER PUBLICATIONS

English Translation of International Search Report for application No. PCT/JP2015/079288 dated Dec. 1, 2015, 2 pages.

* cited by examiner

TERMINAL FITTING AND CONNECTOR

CROSS REFERENCE TO RELATED APPLICATIONS

This application claims the priority of Japanese patent application JP 2014-221099 filed on Oct. 30, 2014, and Japanese patent application JP 2015-027786 filed on Feb. 16, 2015, the entire contents of which are incorporated herein.

TECHNICAL FIELD

The present invention relates to a terminal fitting and a connector.

BACKGROUND ART

A terminal fitting including a backing material made of Cu (copper) alloy and a Sn (tin) plating coating covering surfaces of the backing material is known as a terminal fitting used for the connection of an electrical circuit. Terminal fittings come in various modes such as fitting-type terminals to be crimped to ends of wires and board terminals to be mounted on circuit boards. These terminal fittings may be singly used or may be used by being incorporated into connectors.

A terminal material in which a Ni (nickel) plating layer, a Cu plating layer and a Sn plating layer are successively laminated on a surface of a Cu alloy base material is frequently used as a terminal material used for terminal fittings (patent literature 1 JP2003-147579). However, since the terminal described in patent literature 1 includes a relatively soft Sn plating layer on the surface, a friction coefficient is high, which presents a problem that an insertion force is large at the time of connection to a mating terminal. Particularly, in the case of using the terminal by incorporating the terminal into a connector, a multipole structure using a plurality of terminals is employed in many cases, wherefore a terminal insertion force tends to increase as the number of the terminals increases. To solve this problem, the present application discloses a technique of forming an alloy-containing layer made of Sn and Pd (palladium) and containing a Sn—Pd alloy on a base material made of copper or copper alloy (patent literature 2 WO2013/168764). A connector plated terminal having such a configuration can reduce a terminal insertion force at the time of connection to a mating terminal more than before.

SUMMARY

As a result of repeated examinations, the present inventors found out that a terminal insertion force could be further reduced in a terminal fitting including an alloy-containing layer containing a Sn—Pd alloy. Specifically, the present application provides a terminal fitting having a smaller terminal insertion force than before by controlling the number of particles made of Sn—Pd based alloy.

One aspect of the present design is directed to a terminal fitting with a backing material made of a metal material, and a plating coating covering a surface of the backing material, wherein the plating coating contains a Sn parent phase and Sn—Pd based particles dispersed in the Sn parent phase and includes an outermost layer having an outer surface in which the Sn parent phase and the Sn—Pd based particles are present, and the number of the Sn—Pd based particles present in the outer surface of the plating coating in a state where only the Sn parent phase is removed is 10 to 400/500 $\mu m^2$.

Another aspect is directed to a connector with the above terminal fitting and a housing for holding the terminal fitting.

The above terminal fitting includes the outermost layer containing the Sn—Pd based particles. The number of the Sn—Pd based particles present in the outer surface of the plating coating in the state where only the Sn parent phase is removed is 10 to 400/500 $\mu m^2$. The above terminal fitting can further reduce a friction coefficient than conventional terminals and, consequently, can reduce a terminal insertion force. This is clear from examples and comparative examples described later.

Further, since the above connector includes the above terminal fitting, an insertion force at the time of connection to a mating connector can be reduced.

EMBODIMENT

Figure 1:
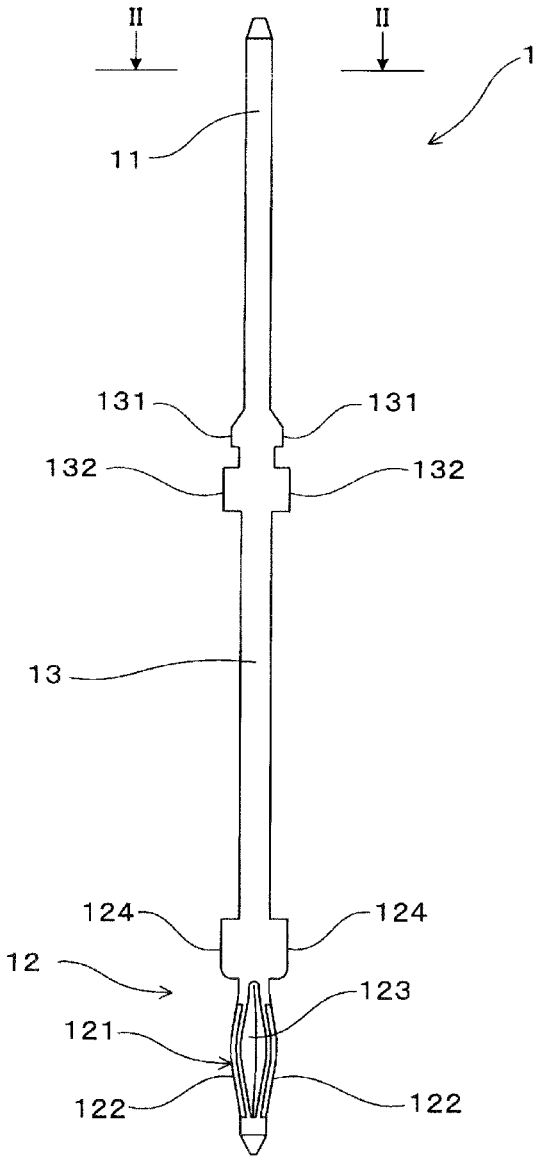
FIG. 1 is a plan view of a terminal fitting in an embodiment.

In the above terminal fitting, the backing material can be selected from various conductive metals. For example, Cu, Al (aluminum), Fe (iron) and alloys containing these metals can be employed as the backing material. Further, the backing material can be fabricated by appropriately applying a combination of cutting, punching and press-molding to a wire material, a plate material or the like made of the above metal as a material.

The plating coating covering the surface of the backing material includes the outermost layer containing the Sn parent phase and the Sn—Pd based particles. The Sn—Pd based particles are present in a dispersed manner in the Sn parent phase and some of them are exposed on the outer surface of the plating coating. Further, the Sn parent phase is exposed on remaining parts of the outer surface of the plating coating. Note that a natural oxide film of Sn or the like may be formed on the outer surface of the outermost layer to such an extent as not to adversely affect effects of reducing the terminal insertion force and improving solder wettability.

The Sn parent phase is a phase containing Sn as a main component. Here, the main component means an element most contained in atomic ratio out of all the elements contained in the Sn parent phase. The Sn parent phase possibly contains Pd not taken into the Sn—Pd based particles, elements constituting the backing material, elements constituting an inner layer to be described later, unavoidable impurities and the like besides Sn as the main component.

The Sn—Pd based particles are particles made of an alloy essentially containing Sn and Pd such as $PdSn_4$. The Sn—Pd based particles possibly contain elements constituting the backing material, elements constituting the inner layer to be described later, unavoidable impurities and the like besides Sn and Pd as essential components.

The content of Pd in the outermost layer can be set to be below 20 atomic % when the sum of Sn and Pd is 100 atomic %. The content of Pd can be set to be preferably below 20 atomic %, more preferably 15 atomic % or less, further preferably 10 atomic % or less and even more preferably 7 atomic % or less in terms of facility to ensure the stability of contact resistance and the like. Note that the content of Pd can be set to be preferably 1 atomic % or more, more preferably 2 atomic % or more, further preferably 3 atomic % or more and even more preferably 4 atomic % or more in terms of the promotion of stable generation of intermetallic compounds such as $PdSn_4$ contributing to a reduction of the friction coefficient.

The plating coating contains 10 to 400 Sn—Pd based particles per 500 $\mu m^2$ in the outer surface in the state where only the Sn parent phase is removed. The terminal fitting containing the Sn—Pd based particles within the above specific range can suppress the deformation and digging of the Sn parent phase, adhesion to a Sn plating film of the mating terminal or the like due to the presence of the Sn—Pd based particles harder than the Sn parent phase. As a result, the friction coefficient at the time of connection to the mating terminal can be reduced more than conventional terminals and, consequently, the terminal insertion force can be more reduced.

If the number of the Sn—Pd based particles in the above state is below 10/500 $\mu m^2$, an effect of reducing the friction coefficient by the Sn—Pd based particles is insufficient. Thus, to obtain a sufficient effect of reducing the friction coefficient, the number of the Sn—Pd based particles in the above state is set to be 10/500 $\mu m^2$ or more. From the same perspective, the number of the Sn—Pd based particles is preferably 100/500 $\mu m^2$ or more and more preferably 150/500 $\mu m^2$ or more.

On the other hand, if the number of the Sn—Pd based particles exceeds 400/500 $\mu m^2$, the Sn parent phase present in the outermost layer is insufficient, wherefore an electrical connection to the mating terminal is not sufficiently formed and an increase of the contact resistance may be caused. Thus, to obtain a sufficient effect of reducing the friction coefficient, the number of the Sn—Pd based particles in the above state is set to be 400/500 $\mu m^2$ or less. From the same perspective, the number of the Sn—Pd based particles is preferably 300/500 $\mu m^2$ or less, more preferably 250/500 $\mu m^2$ or less and further preferably 200/500 $\mu m^2$.

A method for selectively etching only the Sn parent phase without etching the Sn—Pd based particles can be used as a method for removing only the Sn parent phase in the outermost layer. In this case, an aqueous solution obtained by dissolving sodium hydroxide and p-nitrophenol into distilled water or the like can be, for example, used as an etching solution.

The area occupation ratio of the Sn—Pd based particles present in the outer surface of the plating coating in the state where only the Sn parent phase is removed is preferably 50 to 80%. The friction coefficient can be further reduced by setting the area occupation ratio within the above specific range in addition to setting the number of the Sn—Pd based particles within the specific range. Further, by setting the area occupation ratio within the above specific range, the contact resistance between the terminal fitting and the mating terminal can be reduced.

The plating coating may include the inner layer provided between the backing material and the outermost layer and having a composition different from the outermost layer. By providing the inner layer, it is possible to obtain functions and effects such as the suppression of the occurrence of bulging and peeling by improving close contact between the plating coating and the backing material or the suppression of dispersion of the metal of the backing material to the outermost layer.

The composition of the inner layer can be appropriately selected according to the material of the backing material and functions and effects desired to be obtained. Further, the inner layer may be composed of only one metal layer or may be composed of two or more metal layers having mutually different compositions. For example, if the backing material is made of Cu or Cu alloy, functions and effects such as an improvement of close contact and the dispersion of the backing material metal described above can be obtained by forming the inner layer made of Ni (nickel) or Ni alloy.

The inner layer preferably includes a Ni—Sn layer having a thickness of 0.4 μm. In this case, the dispersion of the backing material metal to the outermost layer can be effectively suppressed by the presence of the Ni—Sn layer. As a result, an effect of improving heat resistance can be obtained and, for example, problems such as an increase of the contact resistance caused by the dispersion of the backing material metal can be suppressed. Note that a thickness of the Ni—Sn layer is an average thickness of the Ni—Sn layer observed in one field when a cross-section of the plating coating is observed at a magnification of 2000 using an electronic microscope.

The above terminal fitting can be configured as a fitting-type terminal, a board terminal and the like having a known shape. The fitting-type terminal includes an electrical contact portion configured to contact a mating terminal and a barrel portion to be crimped to a wire. In the case of configuring the above terminal fitting as a fitting-type terminal, the effect of reducing the terminal insertion force by a plating coating can be exhibited if at least the electrical contact portion includes the plating coating. Further, in a fitting-type terminal pair composed of a male terminal and a female terminal, the effect of reducing the terminal insertion force can be exhibited if at least one terminal is the above terminal fitting including the plating coating, and the terminal insertion force can be more reduced if the both terminals are the above terminal fittings.

In the case of configuring the above terminal fitting as a board terminal, the terminal fitting may be used by being connected to a circuit board while being held in a housing or may be used by being directly connected to the circuit board. In the former case, since a plurality of terminal fittings are normally held in the housing, an increase of the insertion force associated with an increase in the number of the terminals is easily suppressed at the time of connection to a mating connector. Thus, the aforementioned effect of reducing the insertion force can be sufficiently exhibited.

Further, the terminal fitting configured as a board terminal integrally includes a terminal connecting portion to be electrically connected to a mating terminal, a board connecting portion to be electrically connected to a circuit board and an intermediate portion present between the terminal connecting portion and the board connecting portion, and at least the terminal connecting portion and the board connecting portion are covered with the plating coating.

The board terminal is normally fabricated by press-working a plate material and punching the plate material into a terminal shape. Thus, in the case of using a plate material having plating applied in advance, a base material is exposed on a fracture surface formed by press-working. The base material exposed on the fracture surface in this way may lead to a reduction of solder wettability, with the result that connection reliability in connecting the board connecting portion and the circuit board by solder joint may be reduced. In contrast, since the plating coating can be formed after press-working in the above terminal fitting, a reduction of solder wettability caused by the exposure of the base material can be avoided.

As just described, the plating coating has good solder wettability and can reduce the friction coefficient during a sliding movement due to the presence of the Sn—Pd base particles. Thus, connection reliability in connecting the terminal fitting to the circuit board by solder joint can be further enhanced by providing the plating coatings on both the terminal connecting portion and the board connecting portion. Further, the plating coatings of the same material can be provided on both the terminal connecting portion and the board connecting portion and it is not necessary to separately apply plating to the both. Thus, a cost increase due to an increase in the number of plating operations can be suppressed. Note that the intermediate portion may or may not be covered with the plating coating.

The board connecting portion may include a press-fit portion configured to be press-fitted into a through hole of the circuit board and form an electrical connection to the circuit board via a conductive portion provided in the through hole. Specifically, the terminal fitting may be configured as a press-fit terminal and the press-fit portion may be covered with the plating coating. The press-fit terminal is configured to resiliently bring the press-fit portion and the conductive portion into contact to form an electrical connection by press-fitting the press-fit portion into the through hole. By providing the plating coating on the press-fit portion, a friction coefficient in press-fitting the press-fit portion into the through hole can be reduced and the shaving, peeling and the like of the plating coating on the press-fit portion can be suppressed. In this way, a good electrical connection can be formed between the press-fit portion and the circuit board.

Further, the above connector may include a plurality of the above terminal fittings. Since the above terminal fitting has a low friction coefficient due to the presence of the plating coating as described above, a connection force increased according to an increase in the number of the terminals can be effectively reduced. Thus, in this case, the connector can be connected to the mating connector with a low connection force.

Figure 2:
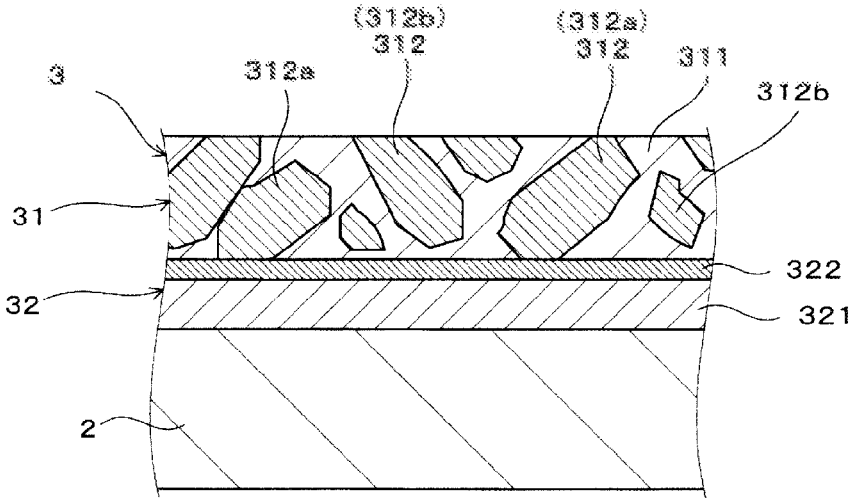
FIG. 2 is a section along II-II of FIG. 1.

An embodiment of the above terminal fitting is described using the drawings. As shown in FIGS. 1 and 2, a terminal fitting 1 includes a backing material 2 made of a metal material and a plating coating 3 covering surfaces of the backing material 2. As shown in FIG. 2, the plating coating 3 contains a Sn parent phase 311 and Sn—Pd based particles 312 dispersed in the Sn parent phase 311 and has an outermost layer 31 having an outer surface in which the Sn parent phase 311 and the Sn—Pd based particles 312 are present. Further, the number of the Sn—Pd based particles 312 present in the outer surface of the plating coating 3 in a state where only the Sn parent phase 311 is removed (see FIG. 3) is 10 to 400/500 $\mu m^2$.

Figure 4:
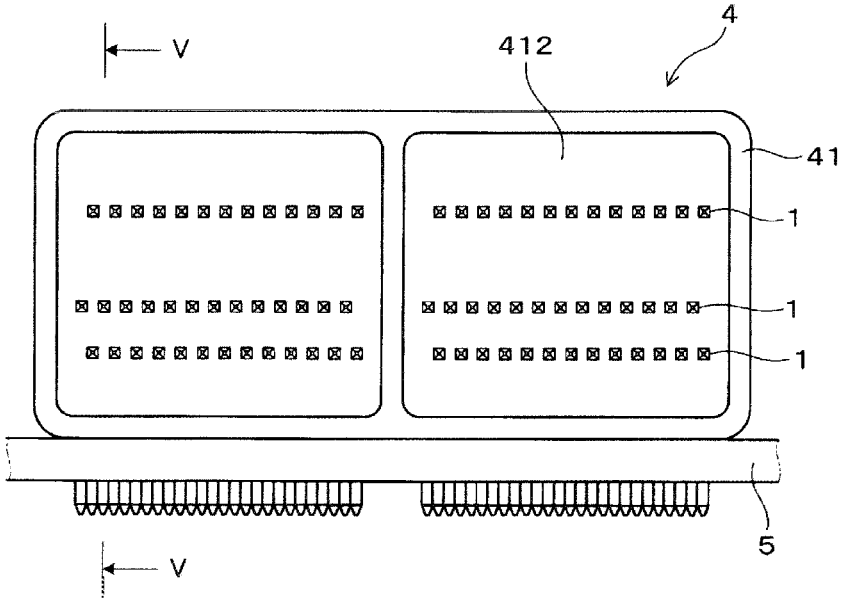
FIG. 4 is a front view of a connector with terminal fittings in the embodiment.
Figure 5:
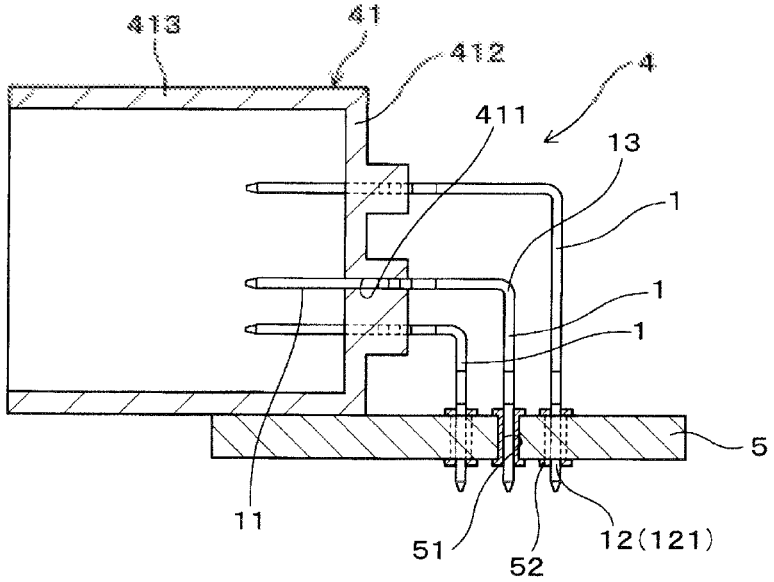
FIG. 5 is a section along V-V of FIG. 4.

As shown in FIGS. 1, 4 and 5, the terminal fitting 1 integrally includes a terminal connecting portion 11 to be electrically connected to a mating terminal (not shown), a board connecting portion 12 to be electrically connected to a circuit board 5 and an intermediate portion 13 present between the terminal connecting portion 11 and the board connecting portion 12. The entire surfaces of at least the terminal connecting portion 11 and the board connecting portion 12 are covered with the plating coating 3.

Further, the terminal fitting 1 of this embodiment is configured as a press-fit terminal. Specifically, as shown in FIGS. 1 and 5, the board connecting portion 12 includes a press-fit portion 121 to be press-fitted into a through hole 51 of the circuit board 5 and form an electrical connection to the circuit board 5 via a conductive portion 52 provided in the through hole 51. The more detailed configuration of the terminal fitting 1 is described together with a manufacturing method.

Figure 6:
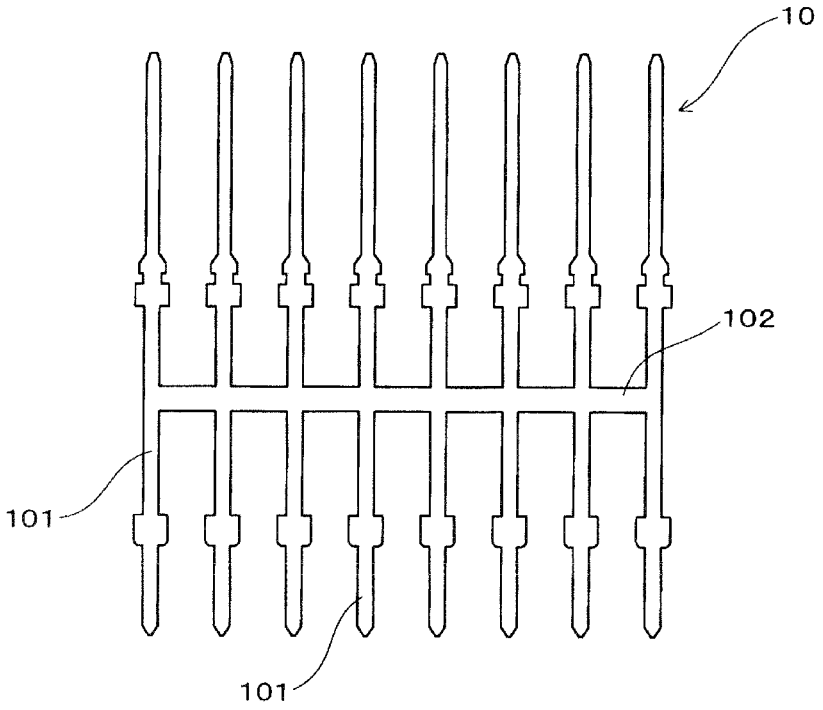
FIG. 6 is a plan view of a terminal intermediate body in the embodiment.

In this example, a terminal intermediate body 10 shown in FIG. 6 was fabricated by press-working a bar material made of Cu alloy. In the terminal intermediate body 10, a plurality of bar-like terminal portions 11 are arranged in parallel to each other and adjacent terminal portions 101 are connected via a carrier 102. As described later, the terminal portion 101 forms the press-fit portion 121, is cut off from the carrier 102 and becomes the terminal fitting 1 after plating is performed.

Subsequently, electroplating was applied to the entire surface of the terminal intermediate body 10 and a Ni plating film, a Pd plating film and a Sn plating film were successively laminated on the surface. Thicknesses of the Ni plating film, Pd plating film and Sn plating film can be respectively appropriately selected within ranges of 0.5 to 2 μm, 0.01 to 0.1 μm and 0.5 to 3 μm. Further, these conditions of electroplating can be appropriately selected from conventionally known conditions. In this example, the thicknesses of the Ni plating film, Pd plating film and Sn plating film were respectively set at 1 μm, 0.02 μm and 1 μm.

After electroplating was applied, the terminal intermediate body 10 was heated to perform a reflow process, thereby forming the plating coating 3. A heating temperature in the reflow process can be appropriately selected within a range of 230 to 400° C. In this embodiment, the terminal intermediate body 10 was heated at a temperature of 350° C. to reflow Ni, Sn and Pd. In this way, the plating coating 3 composed of an inner layer 32 and the outermost layer 31 was formed on the backing material 2 as shown in FIG. 2.

The inner layer 32 of this example was composed of a Ni layer 321 in contact with the backing material 2 and a Ni—Sn layer 322 in contact with the Ni layer 321. Note that the Ni—Sn layer 322 is a layer formed by alloying a part of the Ni plating film and a part of the Sn plating film. Thicknesses of the Ni layer 321 and the Ni—Sn layer 322 were respectively 0.8 μm and 0.58 μm.

The outermost layer 31 contains the Sn parent phase 311 and the Sn—Pd based particles 312 dispersed in the Sn parent phase 311 and both the Sn parent phase 311 and the Sn—Pd based particles 312 were exposed on the outer surface. A thickness of the outermost layer 31 was 0.7 μm.

After the above reflow process was performed, the terminal intermediate body 10 was press-worked and the terminal connecting portion 11 and the board connecting portion 12 were formed on each individual terminal portions 101. Thereafter, the terminal portion 101 was cut off from the carrier 102 by punching to obtain the terminal fitting 1.

The terminal fitting 1 of this example obtained in the above way includes the plating coating 3 on the entire surfaces of the terminal connecting portion 11 and the board connecting portion 12. Further, in this example, the plating coating 3 is formed also substantially on the entire surface of the intermediate portion 13. Note that although the intermediate portion 13 has a fracture surface where the backing material 2 is exposed in a part cut off from the carrier 101, the exposure of the backing material 2 in the intermediate portion 13 does not adversely affect a terminal insertion force and connection reliability in solder joint.

Figure 3:
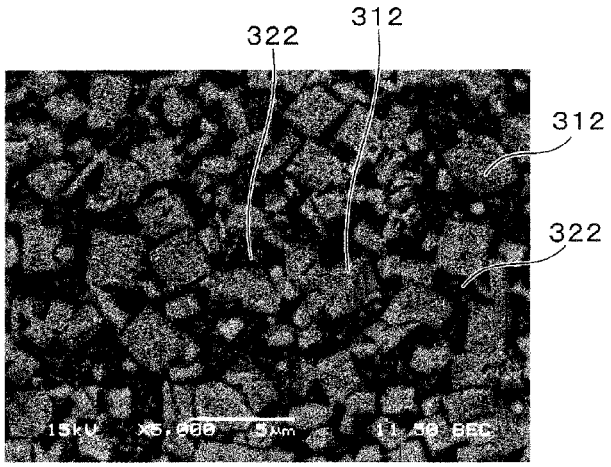
FIG. 3 shows a SEM image obtained by observing a surface of the terminal fitting in a state where a Sn parent phase is removed.

FIG. 3 shows an example of a SEM (scanning ion microscope) image of the surface of the terminal fitting 1 in a state where the Sn parent phase 311 is removed by etching. As is known from FIG. 3, the Sn—Pd based particles 312 having a substantially rectangular parallelepiped shape were present in a dispersed manner in the surface having the Sn parent phase 311 removed therefrom. Further, the Ni—Sn layer 322 exposed by removing the Sn parent phase 311 was observed between the Sn—Pd based particles 312.

When the number of the Sn—Pd based particles 312 present per 500 $\mu m^2$ was counted based on the obtained SEM image, it was confirmed that 153 Sn—Pd based particles 312 were present per 500 $\mu m^2$. Further, when a binarization based on contrast was applied to the SEM image and an area occupation ratio of the Sn—Pd based particles 312 was calculated from the obtained binarized image, the area occupation ratio of the Sn—Pd based particles 312 was 65%. Note that a contrast threshold value in the binarization was set such that the outlines of the Sn—Pd based particles 312 in the binarized image substantially match those of the Sn—Pd based particles 12 in the SEM image.

The terminal fitting 1 of this example is configured to be applicable to a connector 4 to be installed in an automotive vehicle. The connector 4 includes a plurality of terminal fittings 1 and a housing 41 for holding the terminal fittings 1. The terminal fittings 1 are bent into an L shape in a state held in the housing 41.

The housing 41 is made of synthetic resin, receptacles 413 for accommodating mating connectors (not shown) at the time of connection are formed on a front side and back walls 412 are integrally formed on the backs of the receptacles 413. The terminal fittings 1 are held in the housing 41 by being press-fitted into terminal press-fit holes 411 formed on the back wall 412 of the housing 41 with the terminal connecting portions 11 in the lead.

As shown in FIG. 1, the terminal connecting portion 11 of this example is formed into a tab shape and inserted into a tubular fitting portion of a mating terminal to form an electrical connection. The intermediate portion 13 is formed such that a pair of retaining portions 131 and a pair of positioning portions 132 protrude in a width direction at an end part on the side of the terminal connecting portion 11. Edges of the retaining portions 131 close to a tip are tapered so that the terminal fitting 1 can be press-fitted into the terminal insertion hole 411 with the terminal connecting portion 11 in the lead, and opposite edges are perpendicular to be retained. Further, edges of the positioning portions 132 close to the tip are perpendicular and locked to an edge part of the terminal insertion hole 411 when the terminal fitting 11 is press-fitted, whereby the terminal fitting 1 is positioned. Further, the intermediate portion 13 is bent into an "L" shape after being locked in the terminal insertion hole 411.

Further, the board connecting portion 12 of this example is formed with the press-fit portion 121. The press-fit portion 121 is formed to substantially arcuately bulge, and the outer surface thereof includes a pair of contact pieces 122 configured to contact the conductive portion 52 of the through hole 51 and a resiliently or plastically deformable thin portion 123 provided between the contact pieces 122 and has a tapered tip. A maximum diameter of the press-fit portion 121 is larger than an inner diameter of the conductive portion 52 in the through hole 51. The press-fit portion 121 is radially pushed and compressed while the thin portion 123 is compressed and deformed, thereby being press-fitted into the through hole 51 to be electrically connected to the conductive portion 52. Note that a pair of jig placing portions 124 with which a press-fitting jig (not shown) is brought into contact in press-fitting the press-fit portion 121 into the through hole 51 are formed to protrude in the width direction on a base end side of the press-fit portion 121.

Next, functions and effects of the terminal fitting 1 of this example are described.

The terminal fitting 1 includes the outermost layer 31 containing the Sn—Pd based particles 312. The number of the Sn—Pd based particles 312 present in the outer surface of the plating coating 3 in the state where only the Sn parent phase 311 is removed is 10 to 400/500 $\mu m^2$. Thus, the terminal fitting 1 can further reduce a friction coefficient than conventional terminals and, consequently, can reduce a terminal insertion force. Further, since the connector 4 includes the terminal fittings 1 having a small friction coefficient, an insertion force at the time of connection to the mating connector can be reduced.

Further, the terminal fitting 1 integrally includes the terminal connecting portion 11 to be electrically connected to the mating terminal, the board connecting portion 12 to be electrically connected to the circuit board 5 and the intermediate portion 13 provided between the terminal connecting portion 11 and the board connecting portion 12, and at least the terminal connecting portion 11 and the board connecting portion 12 are covered with the plating coating 3. Furthermore, the board connecting portion 12 includes the press-fit portion 121 to be press-fitted into the through hole 51 of the circuit board 5 and form an electrical connection to the circuit board 5 via the conductive portion 52 provided in the through hole 51. Thus, a friction coefficient in press-fitting the press-fit portion 12 into the through hole 51 can be reduced and the shaving, peeling and the like of the plating coating 3 in the press-fit portion 121 can be suppressed. In this way, a good electrical connection to the circuit board 5 can be formed.

Experimental Example

This example is an example of measuring the friction coefficient of the terminal fitting 1 in the embodiment. In this example, a Cu alloy plate material was used as the backing material 2 and the plating coating 3 was formed on the surface by a method similar to that of the embodiment, thereby fabricating a sample E1. Further, a sample E2 was fabricated by changing the heating temperature in the reflow process to 320° C. in the method of the embodiment.

Further, samples C1, C2 as two types of comparative samples were fabricated for comparison with the samples E1 and E2. The sample C1 is a sample fabricated by a method similar to that of the embodiment such that the heating temperature in the reflow process was changed to 300° C. Further, the sample C2 is a sample equivalent to a conventional Sn reflow plated member and fabricated by successively forming a Ni plating film having a thickness of 1 μm and a Sn plating film having a thickness of 1 μm on the surface of the Cu alloy plate material and, thereafter, applying the reflow process.

Figure 7:
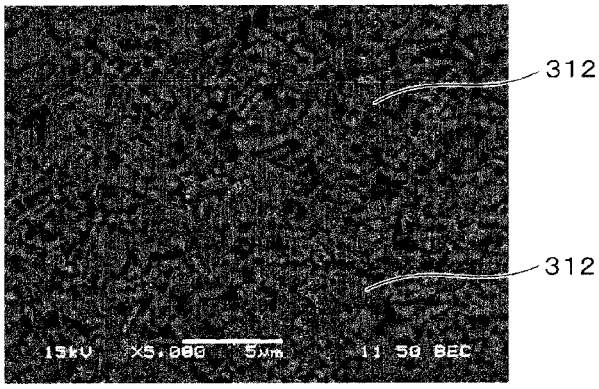
FIG. 7 shows a SEM image obtained by observing a surface of a sample C1 in a state where a Sn parent phase is removed in an experimental example.

Similarly to the sample E1, the outermost layers 31 composed of the Sn parent phase 311 and the Sn—Pd based particles 312 were formed on the surfaces of the samples E2 and C1. FIG. 7 shows a SEM image of the surface of the sample C1 in a state where only the Sn parent phase 311 is removed by etching. As is known from FIG. 7, the inner layer 32 in the sample C1 was covered with the densely formed Sn—Pd based particles 312.

When the number of the Sn—Pd based particles 312 present per 500 $\mu m^2$ was counted based on a SEM image (not shown) of the sample E2, it was confirmed that 203 Sn—Pd based particles 312 were present per 500 Further, when the binarization based on contrast was applied to the SEM image and an area occupation ratio of the Sn—Pd based particles 312 was calculated from the obtained binarized image, the area occupation ratio of the Sn—Pd based particles 312 in the sample E2 was 75%. Further, a thickness of the Ni—Sn layer in the sample E2 was 0.45 μm.

When the number of the Sn—Pd based particles 312 present per 500 $\mu m^2$ was counted based on the SEM image of the sample C1, it was confirmed that 466 Sn—Pd based particles 312 were present per 500 Further, when the binarization based on contrast was applied to the SEM image and an area occupation ratio of the Sn—Pd based particles 312 was calculated from the obtained binarized image, the area occupation ratio of the Sn—Pd based particles 312 in the sample C1 was 87%. Further, a thickness of the Ni—Sn layer in the sample C1 was 0.32 μm.

Since the sample C2 was provided with no Pd plating film in applying electroplating to the terminal intermediate body 10, the Sn—Pd based particles 312 were not formed after the reflow process. Note that a thickness of the Ni—Sn layer in the sample C2 was 0.24 μm.

<Friction Test>

A friction test was conducted in the following procedure using the obtained four types of samples. First, a part of the sample E1 was cut off and press-working was applied to an obtained plate-like member to fabricate a mating member including a semispherical embossed portion having a radius of 1 mm. Subsequently, each sample was brought into contact with the semispherical embossed portion of the mating member and a load of 3 N was applied between the both. Then, while this load was maintained, the semispherical embossed portion was moved at a speed of 6 mm/sec with respect to the sample and a dynamic friction coefficient of the sample was measured.

Figure 8:
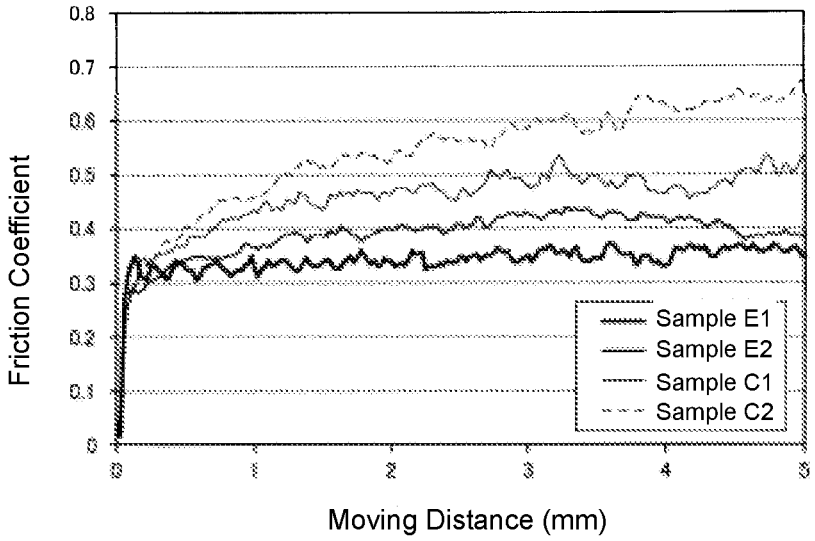
FIG. 8 is a graph showing a result of a friction test in the experimental example.
Figure 9:
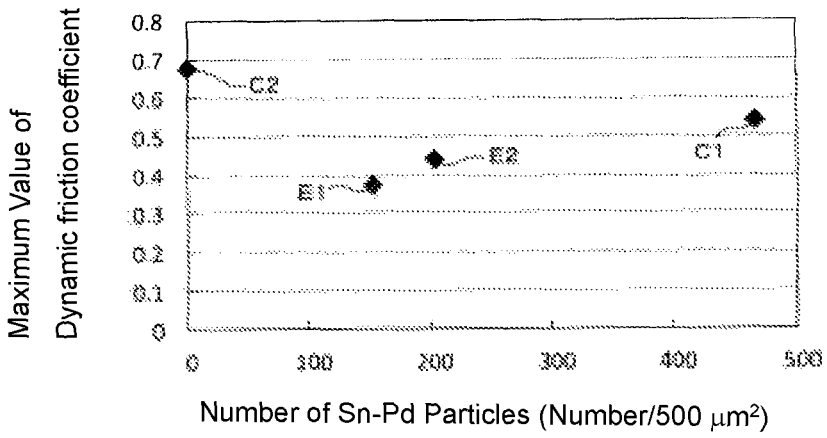
FIG. 9 is a graph plotting maximum values of dynamic friction coefficients in FIG. 8.

FIGS. 8 and 9 show a measurement result on the friction coefficients of the samples E1, E2, C1 and C2. Note that a vertical axis of FIG. 8 represents the friction coefficient and a horizontal axis represents a moving distance of the semispherical embossed portion. Further, a vertical axis of FIG. 9 represents a maximum value of the dynamic friction coefficient of each sample and a horizontal axis represents the number of the Sn—Pd based particles 312.

As is known from FIGS. 8 and 9, it can be understood that the samples E1 and E2 have a lower friction coefficient than the samples C1 and C2 and the sample E1 has a lowest friction coefficient out of four types of samples. Further, as is known from FIG. 9, the maximum value of the friction coefficient of the sample E1 can be reduced by about 45% and the maximum value of the friction coefficient of the sample E2 can be reduced by about 35% on the basis of the sample C1.

The samples E1 and E2 are thought to be able to reduce the friction coefficient more than the samples C1 and C2 since the number of the Sn—Pd based particles 312 contained in the outermost layer 31 of the plating coating 3 and the area occupation ratio of the Sn—Pd based particles 312 after the Sn parent phase is removed lie within the above specific ranges.

Specifically, if FIGS. 3 and 7 are, for example, compared, the individual Sn—Pd based particles 312 contained in the sample E1 have a larger particle diameter than the Sn—Pd based particles 312 contained in the sample C1 and distances between adjacent Sn—Pd based particles 312 of the sample E1 tend to be longer. Thus, it can be estimated that the Sn—Pd based particles 312 contained in the sample E1 are in contact with the inner layer 32 (reference signs 312*a* in FIG. 2) at a higher ratio. Therefore, the sample E1 is thought to be such that a contact load applied at the time of connection to the mating terminal or the like is easily transferred to the backing material 2 via the Sn—Pd based particles 312 and the inner layer 32. As a result of the above, the sample E1 can suppress the deformation and abrasion of the outermost layer 31 and, consequently, can reduce the friction coefficient. Further, the sample E2 is also thought to be able to reduce the friction coefficient for the same reason as the sample E1.

On the other hand, if the number of Sn—Pd based particles 312 becomes excessive as in the sample C1, a great number of fine Sn—Pd based particles 31 are formed. Thus, a ratio of the Sn—Pd based particles 312*b* not in contact with the inner layer 32 (see FIG. 2) is thought to be higher than in the samples E1 and E2. Such Sn—Pd based particles 312 are less effective in suppressing the deformation and abrasion of the Sn parent phase 311 when a contact load is applied since the soft Sn parent phase 311 is present between the Sn—Pd based particles 312 and the backing material 2. Therefore, the sample C1 is thought to have a higher friction coefficient than the samples E1 and E2.

As described above, it can be understood that the Sn—Pd based particles 312 tend to become smaller in particle diameter as the number thereof contained in the outer surface increases. Thus, by controlling the number of the Sn—Pd based particles 312 within the above specific range, the Sn—Pd based particles 312 of a suitable size can be formed and, as a result, an effect of reducing the friction coefficient is thought to be obtainable.

Note that the method for controlling the number of the Sn—Pd based particles 312 is not necessarily defined at present, but it is confirmed that the particle diameter of the Sn—Pd based particles 312 increases and the number of the Sn—Pd based particles 312 contained in the outermost layer is easily controlled within the above specific range if the heating temperature in the reflow process is increased. Thus, it is preferable to increase the heating temperature in the reflow process in order to control the number of the Sn—Pd based particles 312 within the above specific range. Specifically, it is preferable to perform the reflow process at 290 to 400° C.

<Heat Resistance Evaluation>

A heat resistance test was conducted in the following procedure using the above four types of samples obtained. First, a contact resistance was measured in a state where the sample is held in contact with a gold probe. Subsequently, the sample was heated at a temperature of 120° C. for 120 hours. After the heating was completed, the sample was cooled to a room temperature and a contact resistance in the state where the sample was held in contact with the gold probe was measured.

Figure 10:
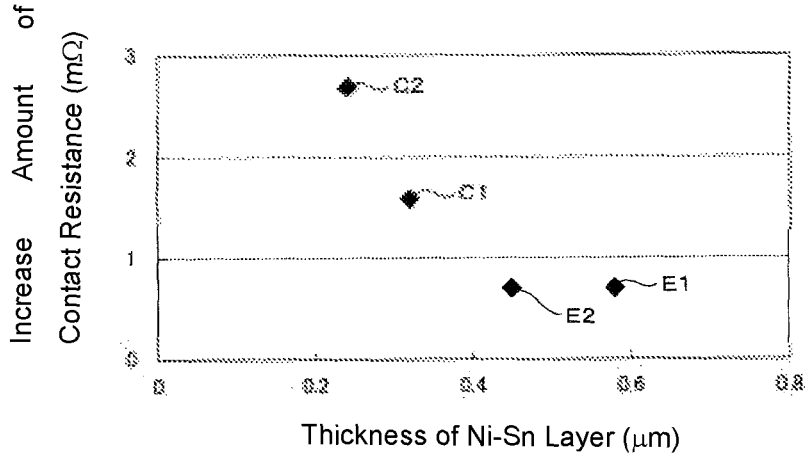
FIG. 10 is a graph showing a result of heat resistance evaluation in the experimental example.

FIG. 10 shows a result of heat resistance evaluation. Note that a vertical axis of FIG. 10 represents an increase amount (me) of the contact resistance obtained by subtracting a value of the contact resistance measured before heating from a value of the contact resistance measured after heating. Further, a horizontal axis of FIG. 10 represents a thickness (μm) of the Ni—Sn layer of each sample.

As is known from FIG. 10, the samples E1 and E2 had a smaller increase amount of the contact resistance than the samples C1 and C2 and could suppress an increase of the contact resistance. As just described, heat resistance of the terminal fitting obtained can be more improved by forming the plating coating including the Ni—Sn layer having a thickness of 0.4 μm or larger on the backing material.

Although an embodiment has been described in detail above, the present invention is not limited to the above embodiment and various changes can be made without departing from the gist of the present invention.

For example, the terminal fitting 1 may be directly mounted on the circuit board 5 without being held in the housing 41 of the connector 4. Further, the board connecting portion 12 in the terminal fitting 1 may be in the form of a pin so as to be soldered and joined. Further, the terminal fitting 1 may be configured as a fitting-type terminal such as a male terminal or a female terminal.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

The invention claimed is:

1. A terminal fitting, comprising:

a backing material made of a metal material; and a plating coating covering a surface of the backing material, wherein:

the plating coating contains a Sn parent phase and Sn—Pd based particles dispersed in the Sn parent phase and includes an outermost layer having an outer surface in which the Sn parent phase and the Sn—Pd based particles are present; and the number of the Sn—Pd based particles present in the outer surface of the plating coating in a state where only the Sn parent phase is removed is 10 to 400 Sn—Pd based particles per 500 $\mu m^2$.

2. The terminal fitting according to claim 1, wherein an area occupation ratio of the Sn—Pd based particles present in the outer surface in the state where only the Sn parent phase is removed is 50 to 80%.

3. The terminal fitting according to claim 1, wherein the plating coating includes an inner layer provided between the backing material and the outermost layer and having a composition different from the outermost layer, and the inner layer includes a Ni—Sn layer having a thickness of 0.4 μm or larger.

4. The terminal fitting according to claim 1, wherein the terminal fitting integrally includes a terminal connecting portion to be electrically connected to a mating terminal, a board connecting portion to be electrically connected to a circuit board and an intermediate portion present between the terminal connecting portion and the board connecting portion, and at least the terminal connecting portion and the board connecting portion are covered with the plating coating.

5. The terminal fitting according to claim 4, wherein the board connecting portion includes a press-fit portion configured to be press-fitted into a through hole of the circuit board and form an electrical connection to the circuit board via a conductive portion provided in the through hole.

6. A connector, comprising:

the terminal fitting according to claim 1; and a housing for holding the terminal fitting.

* * * * *